US007221887B2

(12) United States Patent
Kimura et al.

(10) Patent No.: US 7,221,887 B2
(45) Date of Patent: May 22, 2007

(54) IMAGE FORMING APPARATUS THAT RECOVERS WASTE TONER INSIDE THEREOF

(75) Inventors: Yoshiyuki Kimura, Tokyo (JP); Ryuta Takeichi, Tokyo (JP); Daisuke Saito, Tokyo (JP); Masaharu Furuya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 74 days.

(21) Appl. No.: 11/109,633

(22) Filed: Apr. 20, 2005

(65) Prior Publication Data

US 2005/0244189 A1 Nov. 3, 2005

(30) Foreign Application Priority Data

Apr. 28, 2004 (JP) ..... 2004-133223

(51) Int. Cl.
*G03G 15/16* (2006.01)
*G03G 21/12* (2006.01)

(52) U.S. Cl. ..... 399/101; 399/121; 399/360

(58) Field of Classification Search ..... 399/101, 399/358, 360, 121

See application file for complete search history.

(56) References Cited

U.S. PATENT DOCUMENTS 6,035,158 A * 3/2000 Asakura et al. ..... 399/101
6,546,220 B1 * 4/2003 Asakura et al.

FOREIGN PATENT DOCUMENTS

| | | | |
|---|---|---|---|
| JP | 09311611 A | * | 12/1997 |
| JP | 2001201992 A | * | 7/2001 |
| JP | 2002-62776 | | 2/2002 |
| JP | 2002229385 A | * | 8/2002 |
| JP | 2002-296922 | | 10/2002 |

* cited by examiner

*Primary Examiner*—Susan Lee
(74) *Attorney, Agent, or Firm*—Oblon, Spivak, McClelland, Maier & Neustadt, P.C.

(57) ABSTRACT

An image forming apparatus that transfers a toner image on a photosensitive element to a recording medium includes a transfer unit that includes a transfer member in a form of an endless belt pressed against an outer surface of the photosensitive element, and that is detachable from a main unit of the image forming apparatus; a first cleaning unit that cleans residual toner on the transfer member; and a waste toner receptacle that collects the residual toner cleaned by the first cleaning unit. The waste toner receptacle is arranged in an inner circumference of the transfer member. The waste toner receptacle is held inside the main unit, so that the transfer unit is detachable from the main unit.

7 Claims, 4 Drawing Sheets

IMAGE FORMING APPARATUS THAT RECOVERS WASTE TONER INSIDE THEREOF

CROSS-REFERENCE TO RELATED APPLICATIONS

The present document incorporates by reference the entire contents of Japanese priority document, 2004-133223 filed in Japan on Apr. 28, 2004.

BACKGROUND OF THE INVENTION

1) Field of the Invention

The present invention relates to an image forming apparatus such as a copier, printer, facsimile, etc., and more particularly, to an image forming apparatus that includes a photosensitive element bearing a toner image on its outer surface and a transfer member in the form of an endless belt being pressed against by the outer surface of the photosensitive element, and that cleans residual toner that is not transferred to a recording medium and is left over on the transfer member, and collects the residual toner in a waste-toner receptacle.

2) Description of the Related Art

Image forming apparatuses that include an intermediate transfer belt directly presses against by the outer surface of a photosensitive element or a recording-medium conveying belt pressed against by the outer surface of the photosensitive element with a recording medium sandwiched between the recording-medium conveying belt and the photosensitive element, and in which a toner image formed on the outer surface of the photosensitive element is transferred to the recording medium have come to be widely used, and with it there is an increasing call for making such image forming apparatuses compact.

One way of achieving compactness in an image forming apparatus that includes an intermediate transfer belt and a recording-medium conveying belt is by using the space available on the undersurface of the intermediate transfer belt or the recording-medium conveying belt that comprise a transfer member in the form of an endless belt. For instance, in the image forming apparatuses disclosed in Japanese Patent Laid-Open Publication No. 2002-62776 and Japanese Patent Laid-Open Publication No. 2002-296922, a waste toner receptacle that cleans and recovers the residual toner left over after the toner image is transferred to the recording medium, is located in the space on the undersurface of the transfer member in the form of an endless belt.

In the invention disclosed in Japanese Patent Laid-Open Publication No. 2002-62776, the waste toner receptacle (waste toner recycling receptacle) detachably set in the image bearing unit, and the entire image bearing unit together with the waste toner receptacle is detachable from the main unit. However, it is not possible to only remove the image bearing body from the main unit without the waste toner receptacle. This feature is disadvantageous since every time the image bearing unit has to be removed for either replacement or overhauling, the waste toner receptacle also comes out with it, leading to a possibility of spillage of the toner inside the image forming apparatus.

Further, in the invention disclosed in Japanese Patent Laid-Open Publication No. 2002-62776, two separate waste toner receptacles are provided for collecting the waste toner recovered by cleaning the image bearing unit and the waste toner recovered by cleaning the photosensitive element.

In the invention disclosed in Japanese Patent Laid-Open Publication No. 2002-296922, even though it is possible to replace the intermediate transfer belt with the waste toner receptacle still mounted in the image forming apparatus, replacing or servicing the intermediate transfer belt takes effort since it involves removing the intermediate transfer from the rollers that support it.

SUMMARY OF THE INVENTION

It is an object of the present invention to solve at least the above problems in the conventional technology.

An image forming apparatus according to one aspect of the present invention, which transfers a toner image on a photosensitive element to a recording medium, includes a transfer unit that includes a transfer member in a form of an endless belt pressed against an outer surface of the photosensitive element, and that is detachable from a main unit of the image forming apparatus; a first cleaning unit that cleans residual toner on the transfer member; and a waste toner receptacle that collects the residual toner cleaned by the first cleaning unit. The waste toner receptacle is arranged in an inner circumference of the transfer member. The waste toner receptacle is held inside the main unit, so that the transfer unit is detachable from the main unit.

Other objects, features, and advantages of the present invention are specifically set forth in or will become apparent from the following detailed description of the invention when read in conjunction with the accompanying drawings.

DETAILED DESCRIPTION

Figure 1:
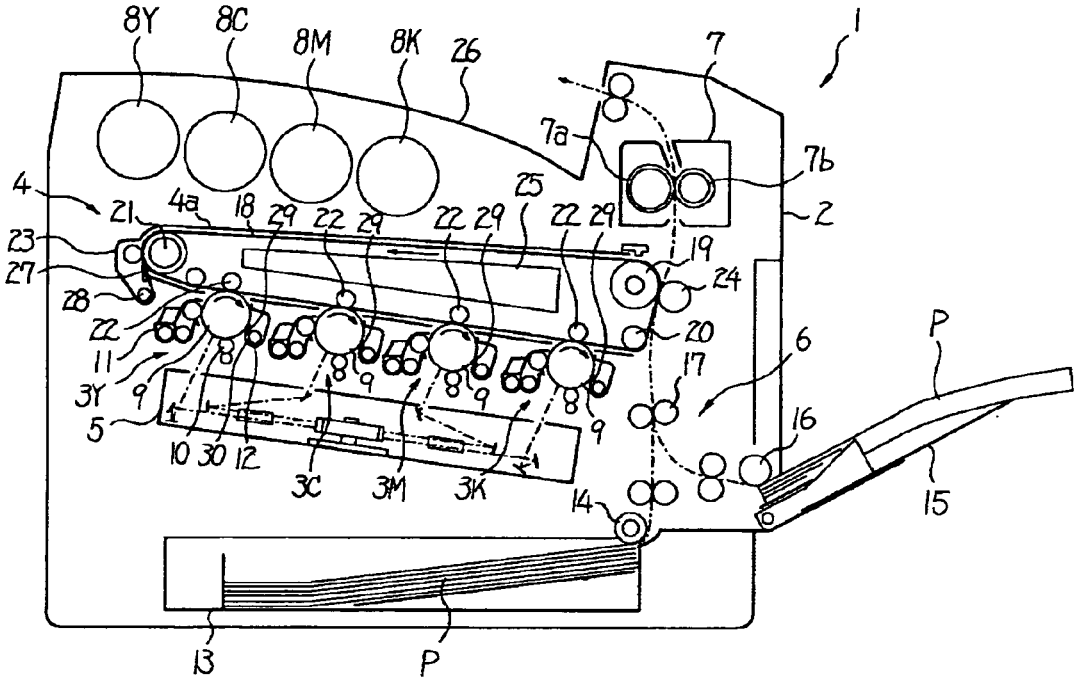
FIG. 1 is a schematic diagram of an interior of a color printer representing an image forming apparatus according to an embodiment of the present invention.
Figure 2:
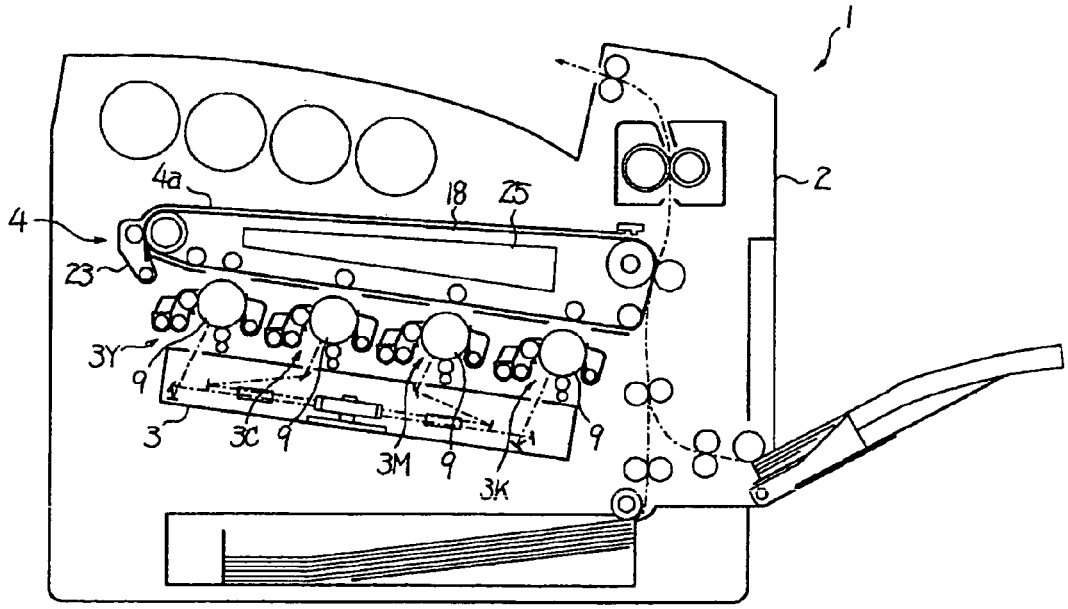
FIG. 2 is a schematic diagram the interior of the color printer in a state in which image stations are moved to locations to put distance between an intermediate transfer belt and a photosensitive element, to remove a transfer unit from a main unit.

Exemplary embodiments of the present invention are explained in detail below with reference to the accompanying drawings. FIG. 1 and FIG. 2 are schematic diagrams of the interior of a color printer representing an image forming apparatus.

As shown in FIG. 1 and FIG. 2, a main unit 2 of a color printer 1 includes four image stations 3Y, 3C, 3M, and 3K (the suffix Y, C, M, and K representing respectively the colors yellow, cyan, magenta, and black) that each forms a toner image of the respective color, a transfer unit 4, an optical writing unit 5, a paper feeder 6, a fixing unit 7, four toner bottles 8Y, 8C, 8M, and 8K, etc.

Each of the four image stations 3 has a similar structure, including a photosensitive element 9 that is driven to turn clockwise in the direction of the arrow shown in FIG. 1. Around the photosensitive element 9 are located a charging roller 10, a developing unit 11, a second cleaning unit which is a photosensitive element cleaning unit 12, etc. arranged in the sequence of the electrostatic printing process. The four photosensitive elements 9 are disposed parallel to one another with equal spacing between them.

Each of the four toner bottles 8 contains a toner of a different color (Y, C, M, and K). When the amount of toner of the developing unit 11 of any image station 3 falls below a predetermined amount, the toner contained in the relevant toner bottle 8 is supplied into the relevant developing unit 11 by a not shown toner transfer mechanism.

The optical writing unit 5 is located below the four image stations 3. The optical writing unit 5 exposes the outer surface of a uniformly charged photosensitive element 9 to a laser beam according to the image data of each color and forms a latent image on the outer surface of the photosensitive element 9. An elongated slit provided between the charging roller 10 and the developing unit 11 allows the laser beam emitted by the optical writing unit 5 to pass. A unit that employs a laser scanning method and that includes a laser source, a polygonal mirror, etc. is used as the optical writing unit 5. The optical writing unit 5 may also be an assembly of a light emitting device (LED) array and an imaging unit.

The paper feeder 6 includes a feeder cassette 13 that is detachable from the main unit 2, a feeding roller 14 that feeds a recording medium P contained in the feeder cassette 13, a manual tray 15 mounted on the side of the main unit 2, a feeding roller 16 that feeds the recording medium P placed in the manual tray.

The fixing unit 7 includes a fixing roller 7*a* and a pressure roller 7*b* and fixes the toner image transferred to the recording medium P by applying heat and pressure.

The transfer unit 4 transfers the toner image formed on the outer surface of each photosensitive element 9 to the recording medium P. The transfer unit 4 includes an intermediate transfer belt which is an endless transfer belt that is pressed against by the outer surface of the photosensitive element 9, three rollers 19, 20, and 21 that rotatably support an intermediate transfer belt 18, four primary transfer rollers 22, a first cleaning unit which is a belt cleaning unit 23, and a unit casing 4*a* that houses all the aforementioned parts. Out of the three rollers 19, 20, and 21, the roller 19 acts as a current receiving roller that receives the current required for transferring the toner image on the intermediate transfer belt 18 to the recording medium P. A secondary transfer roller 24 presses against the roller 19 with the intermediate transfer belt 18 between them. The four primary transfer rollers 22 are located pressed against the four photosensitive elements 9 with the intermediate transfer belt 18 between them. The roller 19 also acts as a driving roller that drives the intermediate transfer belt 18 to move. The transfer unit 4 is detachable from the main unit 2. When the transfer unit 4 is slid into the main unit 2, the driving unit and the roller 19 are interlinked inside the main unit 2. When the transfer unit 4 is attached to or detached from the main unit 2, the image station 3 shifts downwards to put distance between the photosensitive element 9 and the intermediate transfer belt 18, as shown in FIG. 2.

A waste toner receptacle 25 is located in the space on the undersurface of the intermediate transfer belt 18. The residual toner on the intermediate transfer belt 18 that is cleaned by the belt cleaning unit 23, and the residual toner on the photosensitive element 9 that is cleaned by the photosensitive element cleaning unit 12 are collected in the waste toner receptacle 25.

The basic functioning of the color printer 1 that has the aforementioned structure is explained next. An image data from an external device such as a personal computer, etc. is sent to the color printer 1. A laser beam from a semiconductor laser device of the optical writing unit 5 is emitted according to the image data. The outer surface of the photosensitive element 9 is uniformly charged beforehand by the charging roller 10. The laser beam exposes the uniformly charged photosensitive element 9, thereby forming a latent image on the outer surface of the photosensitive element 9 according to the image data. The toner supplied by the developing unit 11 attaches itself to the latent image and the latent image becomes a visible toner image. The visible toner image on the photosensitive element 9 is transferred to the intermediate transfer belt 18 that moves with the photosensitive element 9 by the transfer action of the primary transfer roller 22. The different toner images of the four photosensitive elements 9 are only one by one transferred to the intermediate transfer belt 18 and a color toner image is formed on the intermediate transfer belt 18.

The color toner image on the intermediate transfer belt 18 is transferred, by the transfer action of the roller 19 and the secondary transfer roller 24, to the recording medium P, which is fed either from the feeder cassette 13 or the manual tray 15, and guided to the transfer position by a resist roller 17.

The toner left over on the intermediate transfer belt after the color toner image is transferred is removed by a cleaning blade 27 of the belt cleaning unit 23 and is carried as waste toner to a not shown waste toner collecting unit by a waste toner screw 28. The toner left over on the photosensitive element 9 after the toner image is transferred to the intermediate transfer belt 18 is removed by a cleaning blade 29 of the photosensitive element cleaning unit 12, and carried to as waste toner to the waste toner collecting unit by a waste toner screw 30. The toner carried to the waste toner collecting unit by the belt cleaning unit 23 and the photosensitive element cleaning unit 12 is channeled to the waste toner receptacle 25.

Figure 3:
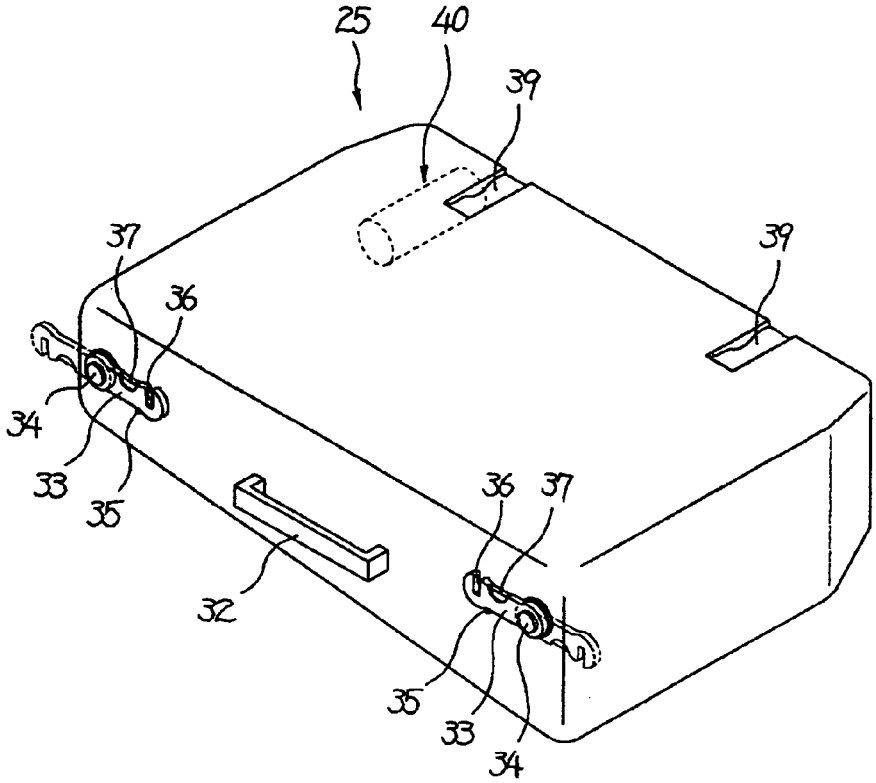
FIG. 3 is a perspective view of a waste toner receptacle.
Figure 4:
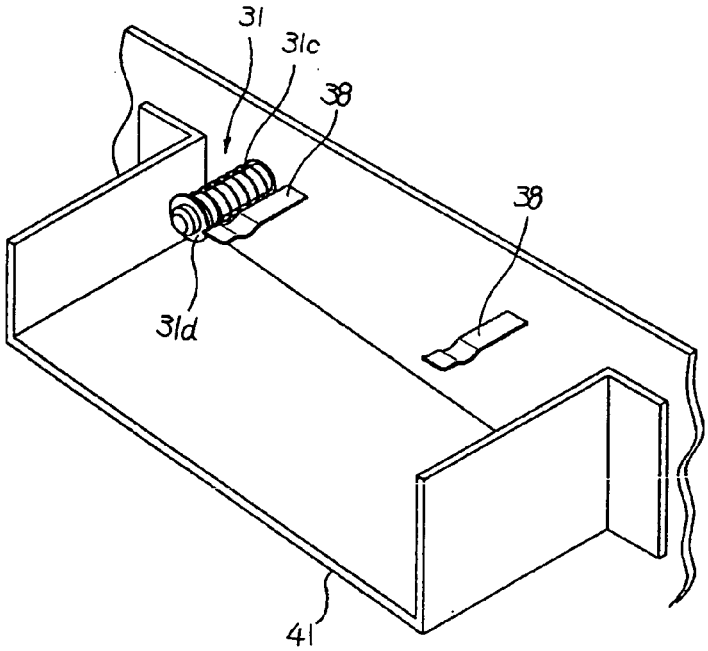
FIG. 4 is a perspective view of the location where the waste toner receptacle is housed in the man body.
Figure 5:
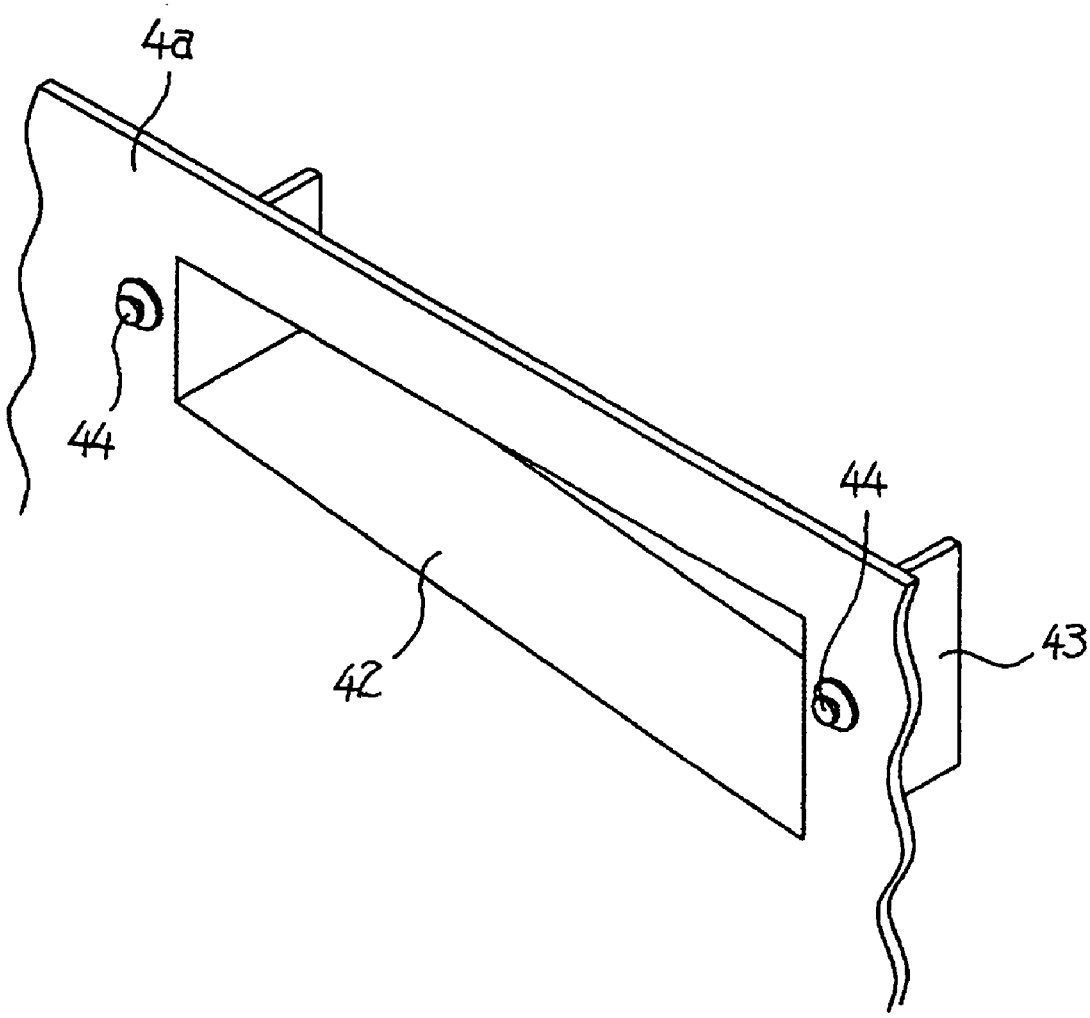
FIG. 5 is an oblique perspective view of a location where the waste toner receptacle is housed in the transfer unit.
Figure 6A:
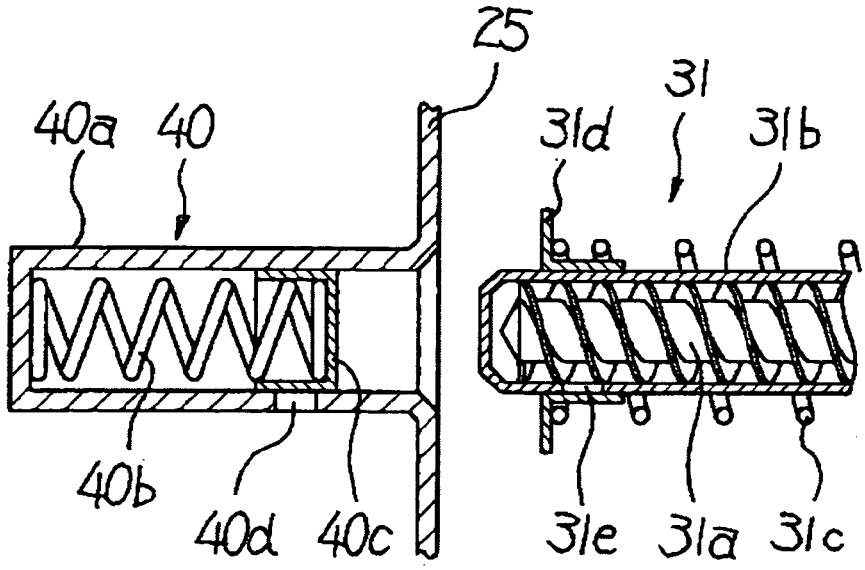
FIG. 6A and FIG. 6B are cross-sections of interlocking parts of a waste-toner conveying unit and the waste toner receptacle.
Figure 6B:
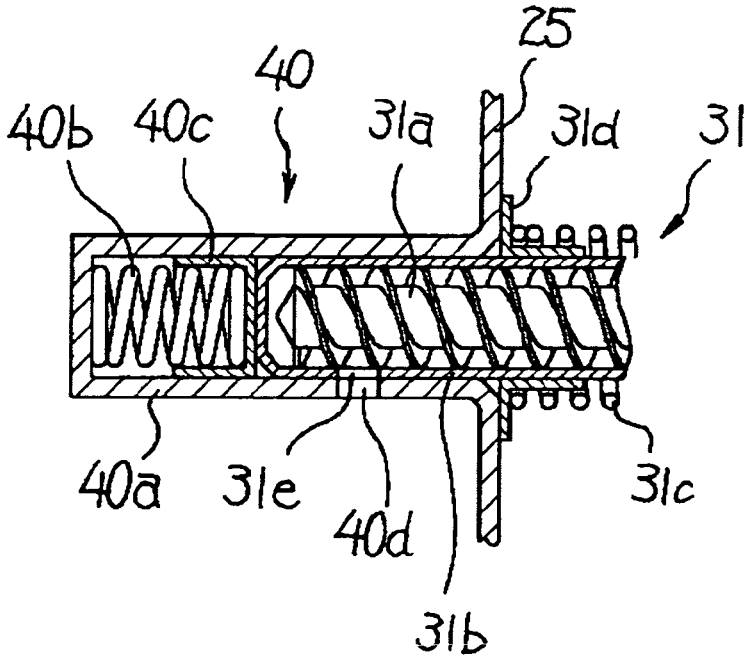

The salient part of the image forming apparatus according to the present embodiment is explained next. FIG. 3 is a perspective view of the waste toner receptacle 25. FIG. 4 is a perspective view of the location where the waste toner receptacle is housed in the main unit 2. FIG. 5 is a perspective view of the location where the waste toner receptacle 25 is housed in the transfer unit 4. FIG. 6A and FIG. 6B are cross-sections of the interlocking parts of a waste-toner conveying unit 31 that carries the waste toner collected in the waste toner collecting unit and the waste toner receptacle 25.

As shown in FIG. 3, the waste toner receptacle 25 is rectangular with a flat contour with a space provided inside for storing the waste toner. The waste toner receptacle 25 is independently detachable from the main unit 2. Further, it is also possible to remove from the main unit 2 as a single unit both the waste toner receptacle 25 and the transfer unit 4.

A handle 32 is provided on the front face of the waste toner receptacle 25 with the aid of which the waste toner receptacle 25 can be pulled out of the main unit 2. A pair of locking members 33 is provided one on each side of the handle 32. Each locking member 33 turns about a spindle 34 to assume an unlocked position represented by solid lines or a locked position represented by phantom lines. When at the locked position, the locking member 33 is stopped by a lug 35, provided on the front face of the waste toner receptacle 25, which maintains the locking member 33 in the unlocked position. The locking member 33 includes a locking pawl 36 and an operating unit 37 that slides the locking pawl to a locked or unlocked state.

There is a gradual taper on the left side, right side, and the bottom of the waste toner receptacle 25 on the side opposite to the side with the handle 32, i.e., on the side facing the image forming apparatus when sliding the waste toner receptacle 25 back into the main unit 2. This tapered end facilitates the operation of sliding the waste toner receptacle 25 into the main unit 2.

On the left side and the right side of the top surface at the end of the waste toner receptacle 25 facing the image forming apparatus are provided a pair of notches 39 into which plate springs 38 provided inside the main unit 2 engage. When the waste toner receptacle 25 is slid into the main unit 2, the plate springs 38 provided inside the main unit 2 engage into the notches 39, thereby properly securing the waste toner receptacle 25 to the main unit 2.

The waste toner receptacle 25 is provided with a waste toner receiving unit 40 at the end facing the main unit 2 into which the front end of the waste-toner conveying unit 31 provided inside the main unit 2 engages. As shown in FIGS. 6A and 6B, the waste toner receiving unit 40 includes a tubular member 40*a* pointing towards the interior of the waste toner receptacle 25, a spring 40*b* housed in the tubular member 40*a*, and a shutter 40*c* that is biased by the spring 40*b* and that slides into the tubular member 40*a*. One end of the tubular member 40*a* is provided with a waste toner receiving opening 40*d*. When the waste toner receptacle 25 is detached from the main unit 2, the waste toner receiving opening 40*d* is kept plugged by the shutter 40*c* (see FIG. 6A).

As shown in FIG. 4, the main unit 2 inside includes a guiding portion 41 into which the waste toner receptacle 25 is slid in and which has a U-shaped cross section, and the plate springs 38 provided one each on the left side and right side and protruding towards the waste toner receptacle 25. When the waste toner receptacle 25 is engaged in the main unit 2, the bottom of the waste toner receptacle 25 rests on the bottom of the guiding portion 41, and the plate springs 38 engage into the notches 39 of the waste toner receptacle 25, thereby securing the waste toner receptacle 25 to the main unit 2.

The main unit 2 also has the waste-toner conveying unit 31. As shown in FIGS. 6A and 6B, the waste-toner conveying unit 31, a tubular member 31*b* that houses a transfer screw 31*a*, a spring 31*c* that is wound around the tubular member 31*b*, and shutter 31*d* that surrounds the tubular member 31*b*, is biased by the spring 31*c*, and that slides along the direction of the axis of the tubular member 31*b*. One end of the tubular member 31*b* is provided with a waste toner ejecting opening 31*e*. When the waste toner receptacle 25 is detached from the main unit 2, the waste toner ejecting opening 31*e* is kept plugged by the shutter 31*d* (see FIG. 6A). The outer diameter of the tubular member 31*b* is slightly smaller than the outer diameter of the tubular member 40*a*.

When the waste toner receptacle 25 is slid into the main unit 2 and the leading end of the waste-toner conveying unit 31 connects with the waste toner receiving unit 40, the tubular member 31*b* enters into the tubular member 40*a*, and the shutter 40*c* is pushed towards the interior the tubular member 40*a* by the tubular member 31*b*, thereby opening up the waste toner receiving opening 40*d*. When the tubular member 31*b* enters into the tubular member 40*a*, the shutter 31*d* comes in contact with the outer surface of the waste toner receptacle 25 and as a result slides against the tubular member 31*b*, causing the waste toner ejecting opening to open. Thus, the waste toner ejecting opening 31*e* and the waste toner receiving opening 40*d* open to each other, with the former above and the latter below, causing the waste toner carried in the tubular member 31*b* to enter the waste toner receptacle 25 (see FIG. 6B).

As shown in FIG. 5, a slot 42 is provided in the front face of the unit casing 4*a* of the transfer unit into which the waste toner receptacle 25 is inserted. A guiding portion 43 leads from the edges of the slot 42. The guiding portion 43 holds the waste toner receptacle 25 that is slid into the main unit 2 and which has a U-shaped cross section. The guiding portion 43 and the guiding portion 41 of the image forming apparatus have substantially similar cross-sectional shape and are disposed side by side without overlapping with each other. When the waste toner receptacle 25 is slid into the main unit 2, the bottom of the waste toner receptacle 25 rests on the bottom of both the guiding portion 41 and the guiding portion 43.

A pair of stepped spindles 44, one on the left side and one on the right side of the slot 42, are provided in the front face of the unit casing 4*a*. The stepped spindles 44 are located where the locking members 33 can engage to them when the waste toner receptacle 25 is slid into the man body 2 and the locking members 33 are turned to the position indicated by the phantom lines in FIG. 3. When the locking members 33 are turned to the locked position and engaged to the stepped spindles 44 from above, the locking pawls 36 engage with the stepped spindles from below, thereby securely engaging the locking members 33 to the stepped spindles 44. When the locking members 33 are turned from the locked position to the unlocked position, the operating units 37 come into play and disengage the locking pawls 36 from the stepped spindles 44 and turn the locking members 33 upward.

Thus, by providing a structure as described above, the residual toner left over on the intermediate transfer belt 18 during image formation is cleaned by the belt cleaning unit 23, and the residual toner left over on the photosensitive element 9 during image formation is cleaned by the photosensitive element cleaning unit 12, and the residual toner of both instances are collected in the waste toner receptacle 25.

The waste toner receptacle 25 is located in the space on the undersurface of the intermediate transfer belt 18. Thus, the space available on the undersurface of the intermediate transfer belt 18, which was a dead space in the conventional models, is effectively utilized, obviating the need to provide extra space for accommodating the waste toner receptacle 25. Thus, compactness can be realized in the color printer 1.

To remove the waste toner receptacle 25 from the main unit 2, a not shown side cover of the main unit 2 is removed to expose the transfer unit 4 and the waste toner receptacle 25. Inside the waste toner receptacle 25 and the transfer unit 4 are interlocked. The waste toner receptacle 25 can be detached from the main unit 2 by turning the locking member 33 towards the unlocked position shown by the solid lines in FIG. 3, and pulling the waste toner receptacle 25 by the handle 32 away from the main unit 2. When the waste toner receptacle 25 is pulled out of the main unit 2, the shutters 31*d* and 40*c*, biased by the springs 31*c* and 40*b*, respectively, slide and plug the waste toner ejecting opening 31*e* and the waste toner receiving opening 40*d*.

Once the waste toner receptacle 25 is removed from the main unit 2, a not shown rubber cap provided to cover a not shown disposal opening is removed and the waste toner collected inside the waste toner receptacle 25 is disposed off. The empty waste toner receptacle 25 is then inserted into the slot 42 of the unit casing 4*a*, and attached to the main unit 2. In the attached condition, the bottom of the waste toner receptacle 25 rests on the bottom of the guiding portions 43 and 41 and the plate springs 38 engage into the notches 39.

After sliding into the main unit 2, the waste toner receptacle 25 is interlocked with the transfer unit 4 by turning the locking members 33 to the locked position.

Thus, it is possible to remove only the waste toner receptacle 25 for replacement or overhaul, making the process of replacement or overhauling very simple.

According to the present embodiment, the transfer unit 4 alone can be removed from the main unit 2, with the waste toner receptacle 25 attached to the main unit 2. To accomplish this, once the side cover of the main unit 2 is removed, the interlocking of the transfer unit 4 and the waste toner receptacle 25 is released by turning the locking members towards the unlocked position. This disengages the transfer unit 4 and the waste toner receptacle 25. Then, the transfer unit 4 can be pulled out of the main unit 2 by just grabbing and pulling the transfer unit 4. In this state, the waste toner receptacle 25 remains securely attached to the main unit 2, the bottom of the waste toner receptacle 25 resting on the bottom of the guiding portion 41, and the plate springs 38 engaged in the notches 39.

Once the task, such as replacement, overhaul, etc., for which the transfer unit 4 is removed from the main unit 2 is completed, the transfer unit 4 is pushed back into the main unit 2 by aligning the slot 42 with the waste toner receptacle 25 inside the main unit 2. Thus, by being able to only remove the transfer unit 4 from the main unit 2 with the waste toner receptacle 25 retained in the main unit 2, the frequency of handling the waste toner receptacle 25 can be reduced, thereby minimizing the possibility of spillage of the toner inside the main unit 2.

Further, according to the present embodiment, it is possible to remove from the main unit 2, as a single unit, both the transfer unit 4 and the waste toner receptacle 25. To accomplish this, once the side cover of the main unit 2 is removed, both the transfer unit 4 and the waste toner receptacle 25 are pulled out and removed from the main unit 2 with the transfer unit 4 and the waste toner receptacle 25 in a locked state by means of the locking member 33.

Once the transfer unit 4 and the waste toner receptacle 25 are removed together as a unit from the main unit 2, the locking members 33 can be released so that the transfer unit 4 and the waste toner receptacle are no longer interlocked. After carrying out the necessary operations like replacement, or overhaul of indicated parts, and disposing off of the waste toner, the transfer unit 4 and the waste toner receptacle 25 can be interlocked again by engaging the locking members 33 and slid back into the main unit 2 as a single unit. Alternatively, the transfer unit 4 and the waste toner receptacle 25 can be slid into the main unit 2 independently.

Thus, if the transfer unit 4 and the waste toner receptacle 25 need to be replaced at the same time or need overhauling at the same time, they can be removed from the main unit 2 as a single unit, making the replacement and overhauling operations very simple.

According to the present embodiment, the transfer unit 4 that includes the intermediate transfer belt 18 as a transfer member is taken as an example. However, the transfer unit 4 that includes a recording-medium conveying belt that conveys the recording medium while being pressed against by the outer surface of the photosensitive element 9 may also applied to the present invention.

According to the present invention, a waste toner receptacle is provided in the space on the undersurface of a transfer member. Thus, the space available on the undersurface of the transfer member is effectively utilized, thereby realizing a compact image forming apparatus. By being able to only remove a transfer unit from the main unit, for replacement or overhauling, with the waste toner receptacle retained in the main unit, the frequency of handling the waste toner receptacle can be reduced, thereby minimizing the possibility of spillage of the toner inside the main unit.

Furthermore, according to the present invention, the waste toner receptacle is independently detachable from the main body. Consequently, replacement or overhaul of the waste toner receptacle can be easily carried out.

Moreover, according to the present invention, the transfer unit and the waste toner receptacle as a unit are detachable from the main unit. Consequently, if replacement or overhaul of both the parts are required at the same time, they can be easily carried out.

Furthermore, according to the present invention, the residual toner on a photosensitive element that is cleaned by a second cleaning unit is also collected in the same waste toner receptacle. Consequently, since no extra space needs to be provided for accommodating a second waste toner receptacle, a more compact image forming apparatus is realized.

Moreover, according to the present invention, the same effects can be achieved if an intermediate transfer belt is used as the transfer member.

Furthermore, according to the present invention, the same effects can be achieved if a recoding medium conveying belt is used as the transfer member.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus that transfers a toner image on a photosensitive element to a recording medium, the image forming apparatus comprising:

a transfer unit that includes a transfer member in a form of an endless belt pressed against an outer surface of the photosensitive element, and that is detachable from a main unit of the image forming apparatus;

a first cleaning unit that cleans residual toner on the transfer member; and a waste toner receptacle that collects the residual toner cleaned by the first cleaning unit, wherein the waste toner receptacle is arranged in an inner circumference of the transfer member, and the waste toner receptacle is held inside the main unit, so that the transfer unit is detachable from the main unit, and wherein the transfer member is a recording-medium conveying belt that conveys the recording medium while having the recording medium pressed against the outer surface of the photosensitive element.

2. An image forming apparatus that transfers a toner image on a photosensitive element to a recording medium, the image forming apparatus comprising:

a transfer unit that includes a transfer member in a form of an endless belt pressed against an outer surface of the photosensitive element, and that is detachable from a main unit of the image forming apparatus;

a waste toner conveying unit that conveys the waste toner cleaned off by a first cleaning unit from the transfer member;

a waste toner recovery unit that recovers residual toner from the waste conveying unit; and a waste toner receptacle that receives the waste toner recovery unit therein so as to collect the residual toner cleaned by the first cleaning unit via the waste toner recovery unit, wherein the waste toner receptacle is arranged in an inner circumference of the transfer member, and the waste toner receptacle is held inside the main unit, so that the transfer unit is detachable from the main unit.

3. The image forming apparatus according to claim 2, wherein the transfer unit is held inside the main unit, so that the waste toner receptacle is detachable from the main unit.

4. The image forming apparatus according to claim 2, wherein the transfer unit and the waste toner receptacle are detachable from the main unit integrally.

5. The image forming apparatus according to claim 2, wherein the transfer member is an intermediate transfer belt on which toner images are sequentially transferred by being pressed against a plurality of photosensitive elements on which the toner images of different colors are formed.

6. The image forming apparatus according to claim 2, wherein the main unit includes a guiding portion that guides the waste toner receptacle when the waste toner receptacle is positioned in the main unit; and a locking member that locks the waste toner receptacle to the main unit.

7. An image forming apparatus that transfers a toner image on a photosensitive element to a recording medium, the image forming apparatus comprising:

a transfer unit that includes a transfer member in a form of an endless belt pressed against an outer surface of the photosensitive element, and that is detachable from a main unit of the image forming apparatus;

a first cleaning unit that cleans residual toner on the transfer member; and a waste toner receptacle that collects the residual toner cleaned by the first cleaning unit, wherein the waste toner receptacle is arranged in an inner circumference of the transfer member, and the waste toner receptacle is held inside the main unit, so that the transfer unit is detachable from the main unit; and a second cleaning unit that cleans the residual toner on the photosensitive element, and wherein the residual toner cleaned by the second cleaning unit is collected in the waste toner receptacle.

* * * * *